US006270421B1

(12) United States Patent
Tsujita

(10) Patent No.: US 6,270,421 B1
(45) **Date of Patent: *Aug. 7, 2001**

(54) DISPLAY UNIT FOR BOWLING ALLEY

(75) Inventor: Masahiro Tsujita, Osaka (JP)

(73) Assignee: Telesystems Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/953,080

(22) Filed: Oct. 17, 1997

(30) Foreign Application Priority Data

Oct. 28, 1996 (JP) ..... 8-285422

(51) Int. Cl.[7] ..... A63D 5/04
(52) U.S. Cl. ..... 473/54; 473/67
(58) Field of Search ..... 465/36; 473/54, 473/58, 67, 69, 71; 273/118 R, 460

(56) References Cited

U.S. PATENT DOCUMENTS

| | | | | |
|---|---|---|---|---|
| 2,550,915 | * | 5/1951 | Curran | 473/54 |
| 3,250,535 | * | 5/1966 | Patterson et al. | 473/58 |
| 4,339,129 | * | 7/1982 | Gautraud | 473/67 |
| 5,241,379 | * | 8/1993 | Tsujita | 358/93 |
| 5,683,080 | * | 11/1997 | Vaioli et al. | 473/58 |
| 5,709,607 | * | 1/1998 | Mowers et al. | 473/58 |

* cited by examiner

*Primary Examiner*—Peter Vo
*Assistant Examiner*—John Paradiso
(74) *Attorney, Agent, or Firm*—Pillsbury Winthrop LLP

(57) ABSTRACT

The display unit includes a plurality of display devices provided in a unit of one lane or a plurality of lanes and each incorporating a wall surface corresponding to the unit and covering the pin setter above the lane as their respective display surfaces, and a display controller for controlling the display according to specified states such as a pin state after a bowl, a score counting state of the bowling game, or a state of a game other than the bowling game which is run based on the pin state or the counted score.

10 Claims, 19 Drawing Sheets

DISPLAY UNIT FOR BOWLING ALLEY

BACKGROUND OF THE INVENTION

The present invention relates to a display unit for bowling alleys for presenting displays to bowlers and spectators in a bowling alley.

In bowling alleys, an automatic bowling scoring system for automatically performing the scoring process has conventionally been installed, where as display devices for the scoring system, a relatively large-size overhead CRT is provided at a ceiling portion before the approach and a small-size CRT is provided within the casing of the console. Some of these CRTs would be designed to display a picture derived from a pin camera that picks up the pin array, or to be equipped with the function of displaying the bowler's bowling form.

Unfortunately, such a conventional display unit in bowling alleys has been not able to give a display to the bowler standing in the approach, but intended to present a display for the other bowlers who are present before the approach, i.e., who are waiting for their turns of bowling. Therefore, it would be the case, for example, that the bowler, after having performed a bowl and then ascertained how the pins have fallen down, returns to the rear of the overhead CRT or console (to a position where the bowler is allowed to view the overhead CRT or the CRT in the console) only to make sure of changes in the score display, or to see a strike, if gotten, applauded. Otherwise, whereas it has also been practiced to display on the CRT a predetermined additional game other the bowling game and to offer some services depending on the result of the additional game, the contents of the additional game could not be ascertained from any positions but positions where the display screen of the CRT within the console or the overhead CRT can be seen.

Any applauding display to be displayed upon a strike as a result of a bowl or depending on the circumstances of the additional game would only be displayed on the CRT within the console or the overhead CRT, such that the applauding display would lack in power.

Furthermore, in the conventional display unit of bowling alleys, while the console is provided every two adjacent lanes, the display screen is provided independently for each lane. As a result, it would be impossible to display messages that require large display area. For this reason, it has been impossible hitherto to present a message with an abundance of information and a high visibility to spectators present in the passage behind the bench or bowlers who are about to begin the bowling game.

SUMMARY OF THE INVENTION

An object of the present invention is therefore to provide a display unit for bowling alleys which is enabled to make a display on the bowling game or other additional game even for the bowler who is standing in the approach.

Another object of the present invention is to provide a display unit for bowling alleys which is enabled to make a powerful display over a wide range on the bowling game or other additional game.

A further object of the present invention is to provide a display unit for bowling alleys which can present a message with an abundance of information and a high visibility even for spectators and bowlers present in the passage behind the bench.

The display unit for a bowling alley according to the present invention comprises:

a plurality of display devices to which, as each one lane or a plurality of lanes within the bowling alley is taken as a unit, a display surface is given by a wall surface corresponding to the unit and covering a pin setter provided above each lane, the display devices incorporating their display surfaces in steps of the unit;

and a display controller for performing display control on display contents of the display surfaces of the plurality of display devices according to a specified state.

With this arrangement, since the wall surface covering the pin setter forms the display surface of the display device, even a bowler present in the approach is allowed to easily view the display surface.

When a plurality of lanes are taken as the unit and the display surface is given in steps of this unit, the display unit can be used as one having a wide display surface extending across a multiplicity of lanes. As a result, it becomes possible, for example, to give a display of high incentive to bowlers present in the approach or spectators present in the passage between console and front.

The display unit for a bowling alley also comprises display control means for causing a display to be made on the display surfaces of the display devices, the content of the display being either one of:

a detection result of pin-state detecting means which detects the pin state of bowling pins after a bowl;

a counting result of score counting means which counts score of a bowling game according to the detection result; or a state of a game other than the bowling game which is run according to the detection result of the pin-state detecting means or the counting result of the score counting means. With this arrangement, it becomes possible to present a display associated with the bowling game or other game even for the bowler present in the approach.

Also, by performing such display control that the display contents are displayed across a plurality of display surfaces, either one of a pin-state detection result, a score counting result or a state of the game other than the bowling game is largely displayed across the display surfaces of the plurality of display devices. As a result, it becomes possible to present a powerful display with an abundance of information and a high visibility.

In addition, when the display surface is constituted in the unit of a plurality of lanes, it also becomes possible to divide and display the display contents within one display surface. As a result, without providing the display device for each lane, a lane-to-lane display can be implemented by providing the display device in the unit of a plurality of lanes and by partly using the display surface of the display device. For example, when one display device is designed to implement displays for two lanes, it is sufficient to provide display devices half in number of the lanes.

When the display device incorporates the wall surface covering the pin setter as a transmitting screen and a projective display is effected from the pin setter side against the screen, the wall surface covering the pin setter is simplified in structure, and moreover the space above the pin setter can be put into effective use.

Also, the display unit for a bowling alley according to the present invention effectively utilizes a wide space of the ceiling, or near the ceiling, above the lanes within the bowling alley, in order to give a powerful display associated with the bowling game or other game.

Accordingly, the display unit for a bowling alley comprises:

a plurality of light emitters arrayed on at least a ceiling, or its peripheries, located above the lanes within the bowling alley; and a light emitter drive controller for performing drive control on the light emitters according to a signal which is issued when a specified state has come up out of either one of:

a detection result of pin-state detecting means which detects the pin state of bowling pins after a bowl;

a counting result of score counting means which counts score of a bowling game according to the detection result; or a state of a game other than the bowling game which is run according to the detection result of the pin-state detecting means or the counting result of the score counting means. With this arrangement., the light emitters on the ceiling or near the ceiling will be drive-controlled when the score state has come to a predetermined state, such as upon occurrence of a strike, upon occurrence of a specified pattern of the score pattern, or upon reach to a specified value of the score total, or when the started-up game other than the bowling game has come to a specified state. As a result, in a sight toward the pin array from the approach, the console installation position, the further rear passages or the like, the ceiling above the lanes or its proximities occupying a wide space will emit light. As a result, a powerful display with high incentive is enabled.

When the light emitter drive controller is so designed as to move and display a light-emitting pattern with the light emitters changed over between light-emitting state and non-light-emitting state, a light-emitting pattern will flow within a wide space, thus allowing the incentive power to be further enhanced.

BRIEF DESCRIPTION OF THE DRAWINGS

FIG. 3 is a block diagram showing the relationships among consoles, masking displays, ceiling displays and the like;

DETAILED DESCRIPTION OF THE PREFERRED EMBODIMENTS

The configuration of the display unit for bowling alleys which is an embodiment of the present invention is described below with reference to FIGS. 1 to 22.

Figure 1:
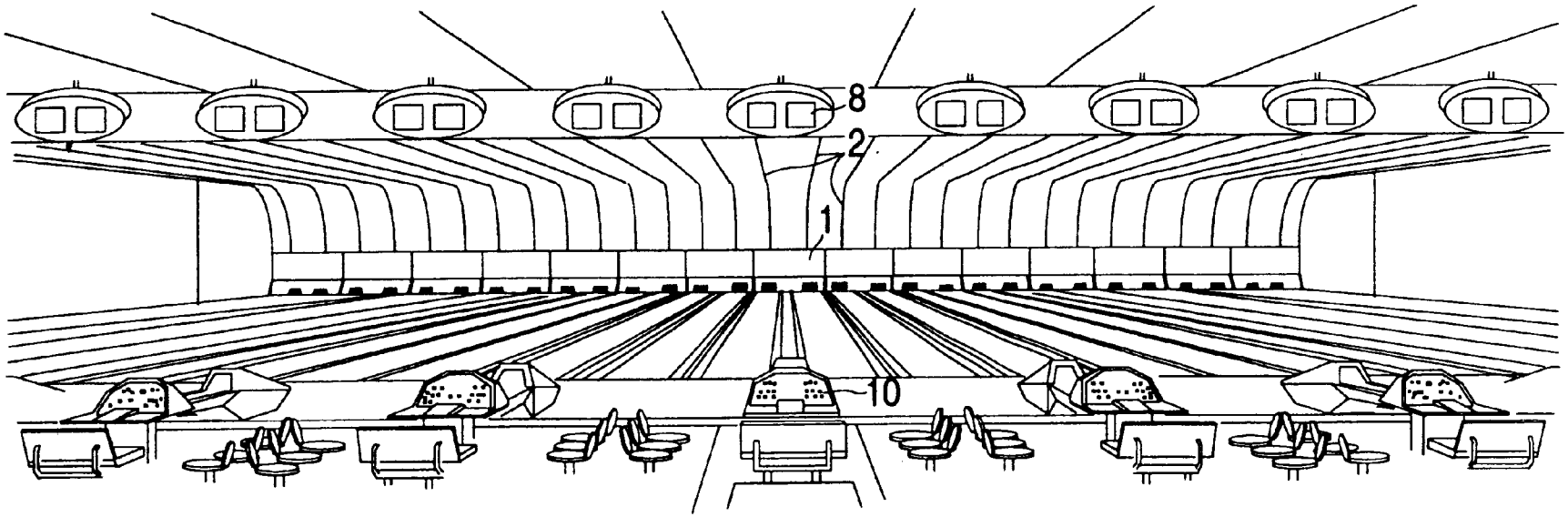
FIG. 1 is a view showing the configuration of an overall bowling alley to which a display unit for bowling alleys according to an embodiment of the present invention is applied.

FIG. 1 is a view showing the configuration of an overall bowling alley, as viewed over the bowling alley from a point before the console. Referring to FIG. 1, a console 10 is provided every two lanes on the fore side of the figure, a masking display 1 is provided at a wall (masking) portion of a far pin setter machine, and a ceiling display 2 is arranged from above the masking display 1 to the ceiling. This masking display 1 corresponds to the display unit, while the ceiling display 2 corresponds to a light emitter. In this example, an overhead CRT similar to conventional ones are also provided on the ceiling obliquely above each console.

Figure 2:
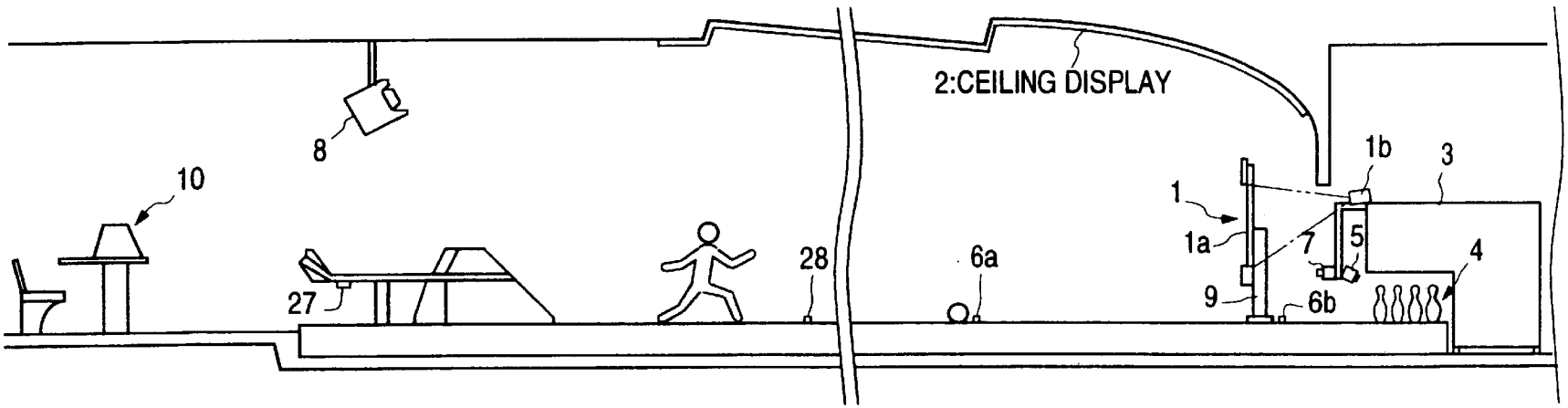
FIG. 2 is a view showing the configuration of the bowling alley, as viewed sideways of a lane.

Referring to FIG. 2, which is viewed sideways of the lane, a pin setter 3 is equipped with a pin camera 5 for image pickup of pins 4 arrayed below the pin setter 3, and a bowling form camera 7 for image pickup of the bowler's bowling form. A projector 1*b* of CRT type or liquid crystal type is attached at an intermediate position of the pin setter for adjacent two lanes, and a masking support 9 is equipped with a masking display screen 1*a* serving also as a wall surface covering the pin setter 3. These projector 1*b* and masking display screen 1*a* constitute the masking display 1 of projection type. As will be described later, if a panel display such as color PDPs (Plasma Display Panels), liquid crystal display panels with back light or side light, or LED display panels is used as the masking display, the need of the projector 1*b* is eliminated. From above the masking display 1 to the ceiling, the ceiling display 2 implemented by an LED or lamp is arrayed in a continuous manner, as described later. Further, a first bowl pass sensor 6*a* is provided on the way of the lane, and a second bowl pass sensor 6*b* is provided before the pin array. A foul sensor 28 is provided between approach and lane, and a bowler sensor 27 for sensing that the bowler has stood in the approach is provided in the bowl return.

Figure 3:
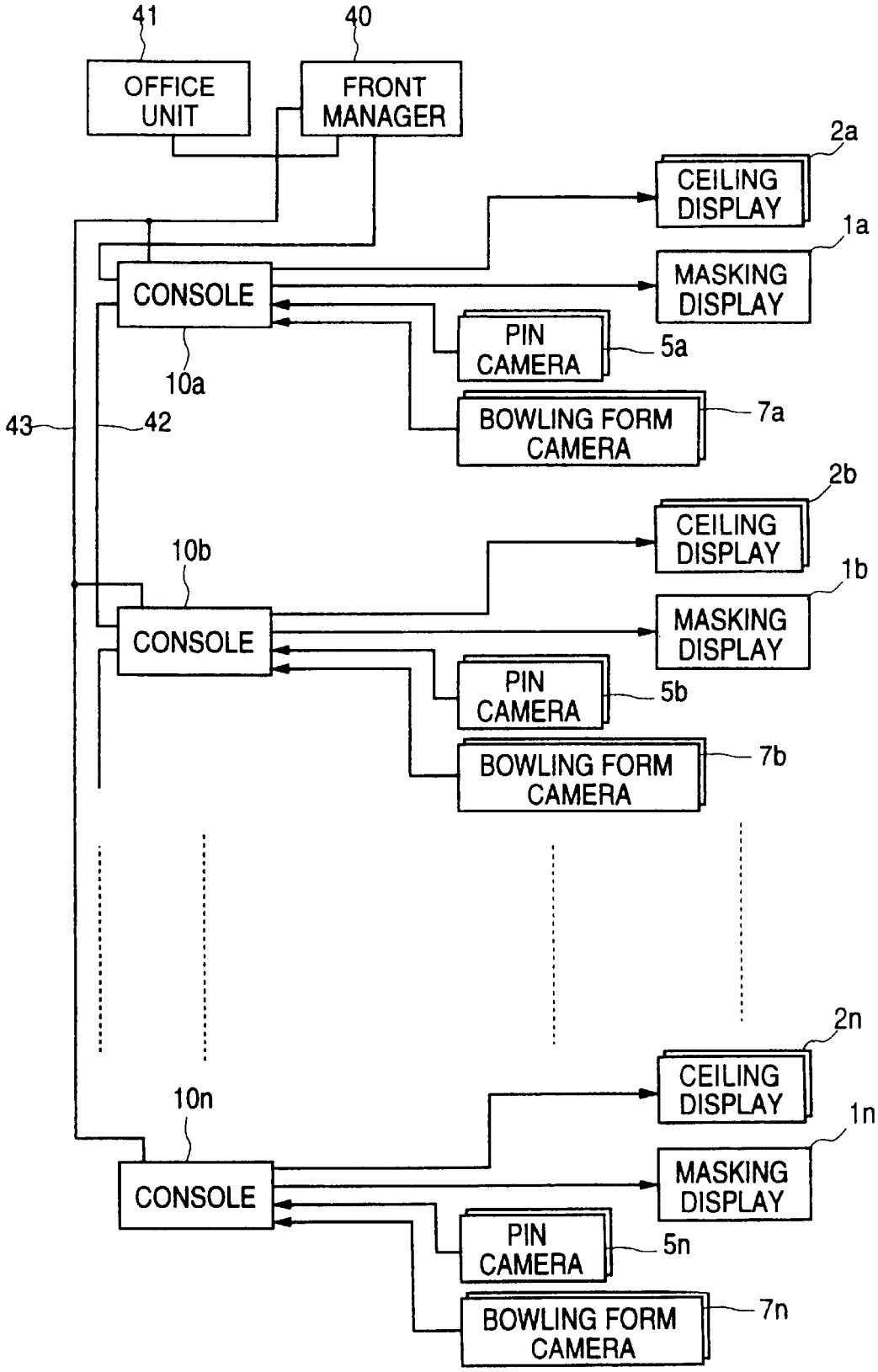

FIG. 3 is a block diagram showing the relationships among consoles, masking displays, ceiling displays and the like. Referring to FIG. 3, the consoles are designated by 10*a*,

10*b*, . . . , 10*n*, respectively, where the consoles, a front manager 40 provided in the front and an office unit 41 provided in the office are connected to one another as a local area network such as Ethernet via a LAN cable 42. Also, the front manager 40 and the individual consoles 10*a*, 10*b*, . . . , 10*n* are connected to each other via a synchronizing signal cable 43. Each console is connected with the ceiling displays 2 for two lanes, one masking display 1 covering two lanes, the pin cameras 5 for two lanes and the bowling form cameras 7 for two lanes. Although the masking display is provided every two lanes in this example, the masking display may be provided one for each lane. Each console performs signal input and output for these lanes to effect the displaying and other processes of the masking display and the ceiling display.

Figure 4:
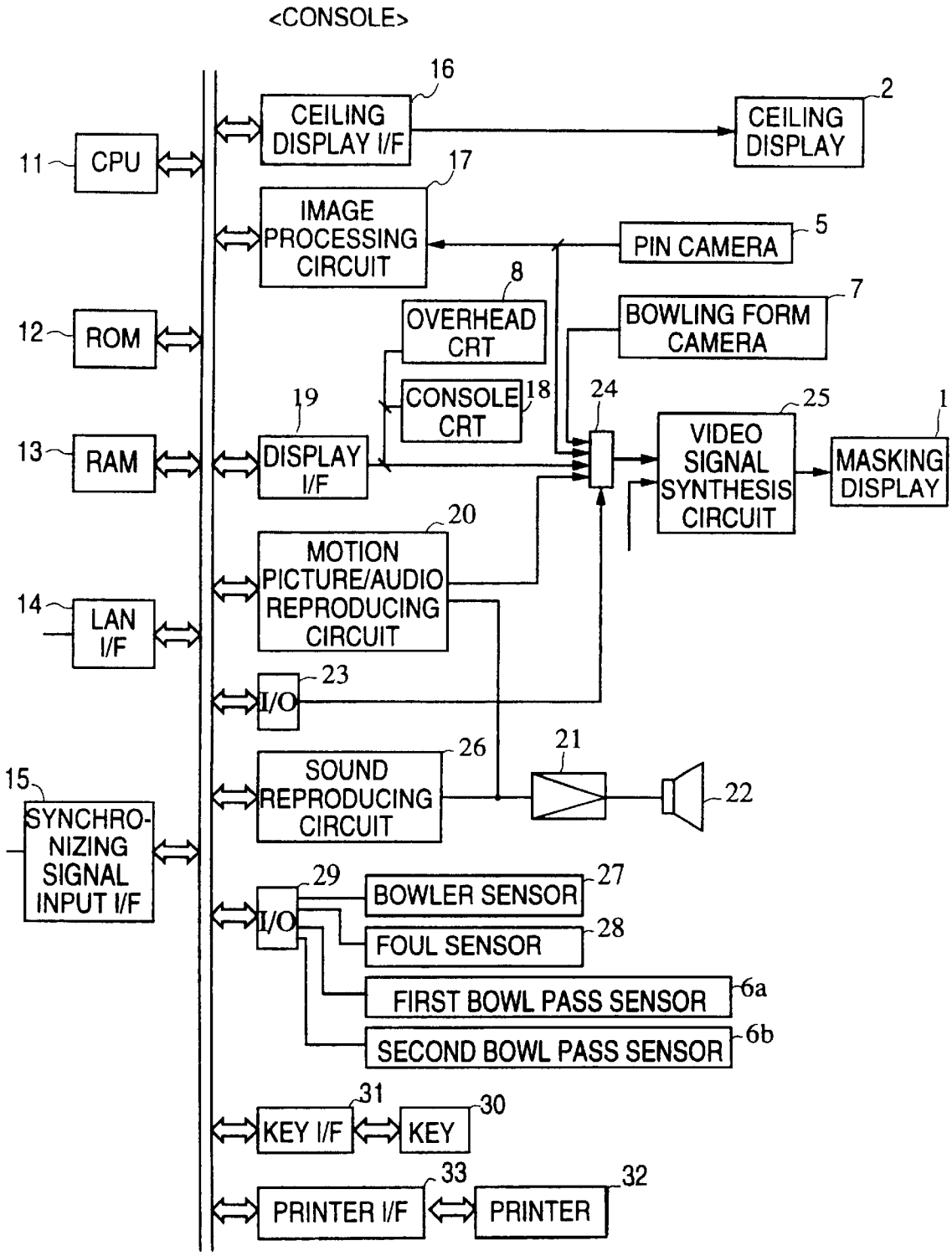
FIG. 4 is a block diagram showing the configuration of the console.

FIG. 4 is a block diagram showing the configuration of the console, where a CPU 11, a ROM 12, a RAM 13, a LAN interface 14, a synchronizing signal input interface 15, a printer interface 33 and a printer 32 are shared by two lanes, while the rest of the blocks is provided for each of the two lanes and depicted only for one of the two in the figure. The CPU 11 executes programs previously written in the ROM 12 to control the scoring process which will be described later, the display process onto the masking display, the display process onto the ceiling display and the like. The RAM 13 is used as a working area during those processes. Storage of motion-picture files, which will be described later, is also effected on this RAM 13. The LAN interface 14 performs data transfer control against the local area network. The synchronizing signal input interface 15 receives a signal outputted from the front manager to synchronize the motion-picture reproducing timing among a plurality of masking displays. A ceiling display interface 16 performs the driving of the ceiling display and the control of the light-emitting pattern based on data of a light-emitting pattern given from the CPU 11. An image processing circuit 17 receives an image signal picked up by the pin camera 5 and performs a specified image processing to generate binarized video data for facilitating the sensing of erect pins and fallen-down pins. The CPU 11 reads the binarized video data to detect the erect/down state of pins. A display interface 19 is a circuit for making displays of the score, game screen and the like, and comprises a display memory and a circuit for generating a display signal from the contents of the display memory. An overhead CRT 8 and a console CRT 18 perform the displaying based on the video signal outputted from the display interface 19. A motion picture/audio reproducing circuit 20 receives data of a motion-picture file (which is a file including not only motion-picture data but also aural data but will hereinafter be referred to simply as "motion-picture file") of the type standardized by MPEG (Moving Picture Experts Group) to reproduce the video signal and the audio signal. Reference numeral 24 denotes a switch circuit for video signals, which selects among video signals derived from the pin camera 5, the bowling form camera 7, the display interface 19 and the motion picture/audio reproducing circuit 20, depending on a control signal outputted from an I/O port 23, to lead the video signal to a video signal synthesis circuit 25. The video signal synthesis circuit 25, which is provided to allow one masking display 1 to be shared by two lanes, synthesizes a video signal by incorporating the video signal for another lane that the relevant console covers, to thereby display a video corresponding to the two lanes on one masking display 1. In addition, when the masking display is provided one for each one lane, the video signal synthesis circuit 25 is no longer necessary and the output of the switch circuit 24 may appropriately be given directly to the masking display. As will be described later, upon sensing the situation that the bowler has stood in the approach, the switch circuit 24 is switched so that the image pickup signal from the bowling form camera 7 is selected. As a result, the bowling form of the bowler who is about to bowl will be displayed on the masking display. In this connection, if the bowling form camera 7 is so arranged as to generate an image signal with the horizontal scanning direction of the raster scan reversed between left and right, then an image with the left and the right reversed would be displayed, as if it were to see a mirror, on the masking display 1. Subsequently, with a bowl effected, as the bowl passes the first bowl pass sensor, selecting the video signal from the pin camera 5 causes a pin action (an image of pins falling down) to be displayed in real time on the masking display 1. Otherwise, an output signal of the display interface 19 is selected to display the score or the like, and a signal from the motion picture/audio reproducing circuit 20 is selected to perform motion-picture reproduction or the like. Designated by 21 is an amplifier for audio signals, which amplifies the audio signal reproduced by the motion picture/audio reproducing circuit 20 and drives a loudspeaker 22. A sound reproducing circuit 26 receives data of, for example, a MIDI data file or waveform data file to reproduce a musical sound signal. The amplifier 21 amplifies this signal and drives the loudspeaker 22. The sound reproducing circuit 26 is used to sound music or voice as the background simultaneously when an animation or a still picture is displayed by using the display interface 19 without using the motion picture/audio reproducing circuit 20. An I/O port 29 is connected with the bowler sensor 27, the foul sensor 28, the first bowl pass sensor 6*a* and the second bowl pass sensor 6*b*, and the CPU 11 reads the detection state of these sensors via the I/O port 29. A key interface 31 reads the contents of a key operation on a keyboard 30. The CPU 11 performs a process responsive to the key operation via the key interface 31. The printer interface 33 drives the printer 32 based on a print signal fed from the CPU 11, printing the score sheet or the like.

Figure 5A:
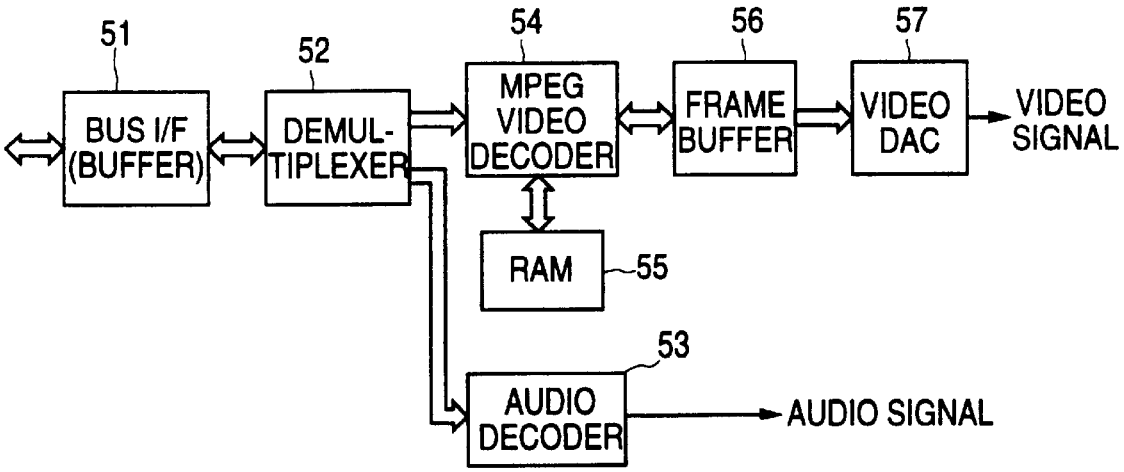
FIGS. 5A and 5B are block diagrams showing the configuration of a motion picture/audio reproducing circuit.
Figure 5B:
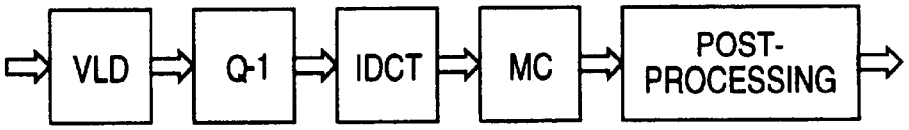

FIGS. 5A and 5B are block diagrams showing the configuration of the motion picture/audio reproducing circuit 20 shown in FIG. 4. Referring to FIG. 5A, a bus interface 51 perform the interface between the motion picture/audio reproducing circuit and the system bus of the console. A demultiplexer 52 separates an MPEG system stream fed from the bus interface 51 into an MPEG video stream and an MPEG audio stream, and feeds them to an MPEG video decoder 54 and an audio decoder 53, respectively. The MPEG video decoder 54 decodes the video data with RAM 55 used as a working area. A frame buffer 56 temporarily stores video data for one frame, and a video D/A converter 57 generates an analog video signal from the video data. The audio decoder 53 decodes the fed MPEG audio stream to produce an audio signal. FIG. 5B is a functional block diagram of the MPEG video decoder 54 in FIG. 5A. A VLD (Variable Length Decoding) section decodes an inputted variable-length code to determine a quantization factor and a motion vector. A $Q^{-1}$ (inverse quantization) section determines a DCT (Discrete Cosine Transform) factor by multiplying the value of a quantization step Q by the quantization factor. An IDCT (Inverse Discrete Cosine Transform) section calculates pixel values (luminance, color difference) for each of 8×8 pixel blocks through an inverse DCT process. However, the values to be determined by the IDCT section are an actual pixel value itself for the I picture, and a difference value between pixel values for the P picture and the B picture. An MC (Motion Compensation) section adds together blocks compensated by the difference value for the P picture and the B picture determined by the IDCT as well as motion vector, thereby decoding the P picture or the B picture. A post-processor performs an interpolating process between lines.

Figure 6:
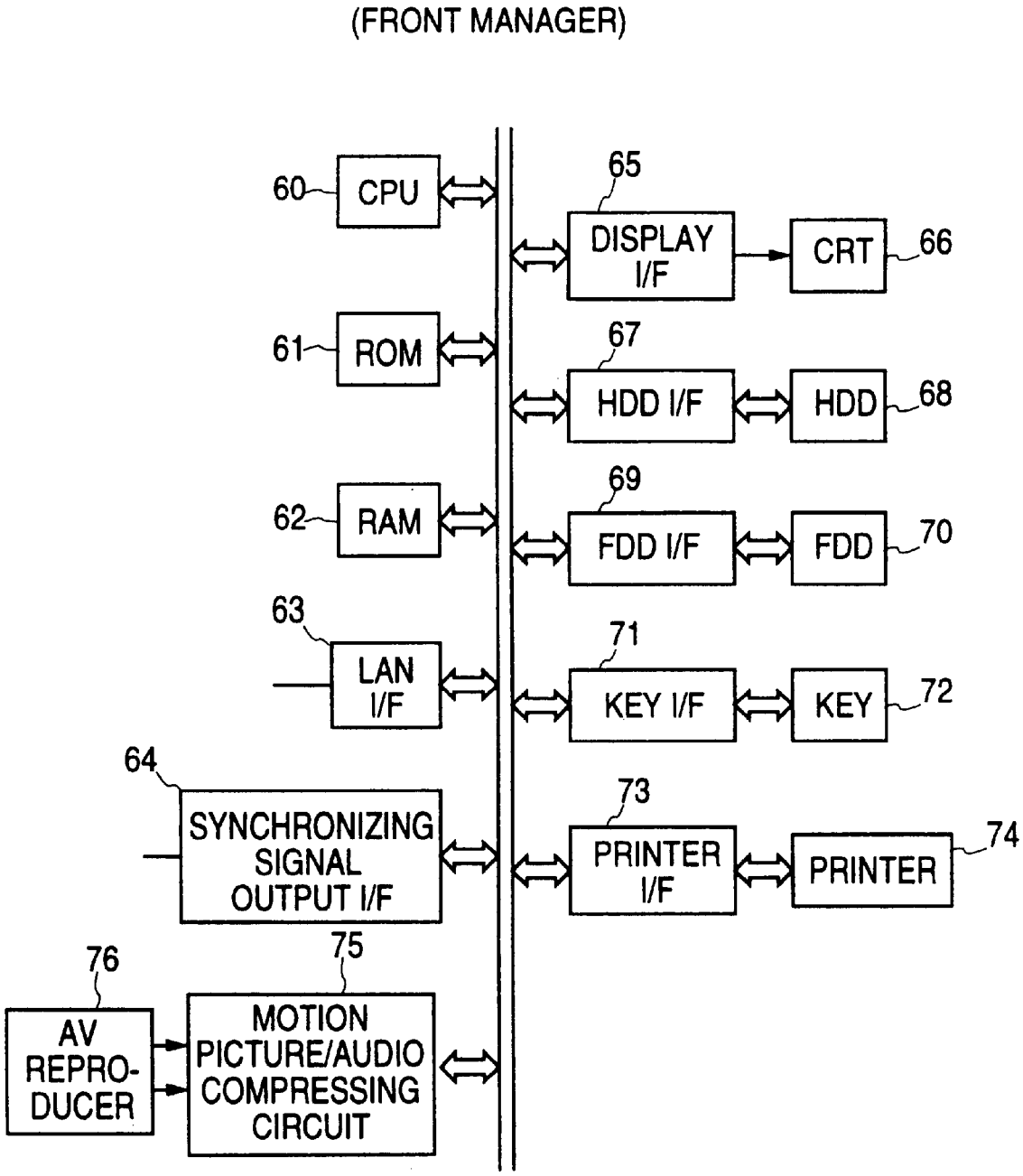
FIG. 6 is a block diagram showing the configuration of the front manager.

FIG. 6 is a block diagram showing the configuration of the front manager. A CPU 60 executes programs previously written in a ROM 61 to implement various processes which will be described later. A RAM 62 is used as a working area during those processes. A LAN interface 63 performs data transfer control against the local area network. A synchronizing signal output interface 64 outputs a synchronizing signal to each console in order to synchronize the motion-picture reproducing timing among a plurality of masking displays. A display interface 65 comprises a display memory as well as a display signal generator circuit for listing and displaying the state of use of each lane, the situation of progress of the game and the like, and displays the contents of the display memory onto a CRT 66. A hard disk drive unit 68 is used to store the programs, motion files and the like to be down-loaded to each console, where the CPU 60 performs read and write of data via a hard disk drive interface 67. A floppy disk drive unit 70 is used to read an externally prepared motion file or the like, where the CPU 60 performs the read of its data or other processes via a floppy disk drive interface 69. A keyboard 72 is used for entering the names of incoming bowlers upon their reception, specifying an empty lane, or entering a message or the like to be displayed onto the masking display, where the CPU 60 reads the contents of a key operation via a key interface 71. A printer 74 is used for printing the score sheet or the like on the front manager side, where the CPU 60 performs print control via a printer interface 73. A motion picture/audio compressing circuit 75 is a circuit for compressing a video signal and an audio signal derived from an AV (Audio-Visual) reproducer 76 such as an LD (Laser Disk reproducer) or DVD (Digital Video Disk reproducer), and is used for previously preparing a motion picture to be displayed on the masking display.

Figure 7:
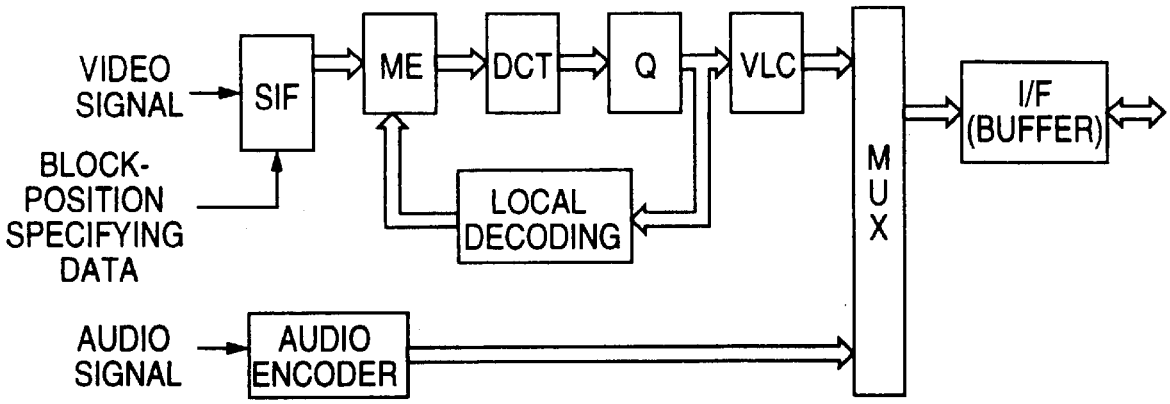
FIG. 7 is a block diagram showing the configuration of the motion picture/audio compressing circuit.

FIG. 7 is a block diagram showing the configuration of the motion picture/audio compressing circuit 75. In this circuit, an SIF (Source Input Format) converter performs format conversion of a source input, that is, the SIF converter performs a field decimation process, a band limitation process of luminance and color difference signals or other processes on original video data of an inputted video signal. In generating this SIF signal, which portion of an image screen attributable to the input video signal is subjected to the input format conversion is based on block-position specifying data. For example, an SIF signal of, for example, 320×240 pixels, 30 frames in a specified position out of, for example, 1280×720 pixels, 30 frames/s is prepared. An ME (Motion Estimation) section calculates motion vectors of the input video on the basis of a 16×16 pixel macro block. A DCT (Discrete Cosine Transform) section performs a two-dimensional discrete cosine transform process in the block size of 8×8 pixels on a difference between the motion-compensated image and the input image. A Q (Quantization) section quantizes the DCT transform factor by using a matrix table, i.e., executes an arithmetic operation of dividing the factor by the value of the quantization step Q and ignoring the remainder). A VLC (Variable Length Coding) section converts the quantized value read by scanning from low frequency terms to high frequency terms into a variable-length code by a combination of run length code and Huffman code to generate an MPEG video stream. A local decoding section performs $Q^{-1}$ and IDCT processes by the procedure shown in FIG. 5B, feeding the result to the ME section as a comparative image. Meanwhile, an audio encoder encodes an inputted audio signal to generate an MPEG audio stream. Then, a multiplexer MUX multiplexes the MPEG video stream and the MPEG audio stream with other data such as the data for synchronizing video and audio with each other to generate a MPEG system stream. An interface I/F performs the interface with the system bus of the front manager shown in FIG. 6.

Figure 8:
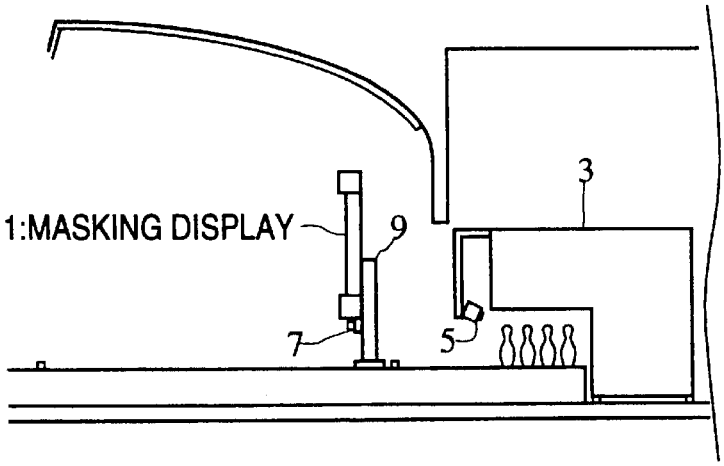
FIG. 8 is a view showing another configuration example of the masking display.

FIG. 8 is a view showing another configuration of the masking display, which corresponds to part of FIG. 2. Referring to FIG. 8, the masking display 1 is a panel display device attached to the masking support 9, being exemplified by a color PDP (a plasma display panel), a liquid crystal panel with backlight or side light, an LED display panel or the like. In this case, even when the installation space for the projector cannot be ensured on the pin setter 3 side, or when enough optical path length cannot be allowed, the masking covering the pin setter can be used as a masking display. In addition, as shown in FIG. 8, the bowling form camera 7 may be provided on the masking support 9 side.

Figure 9A:
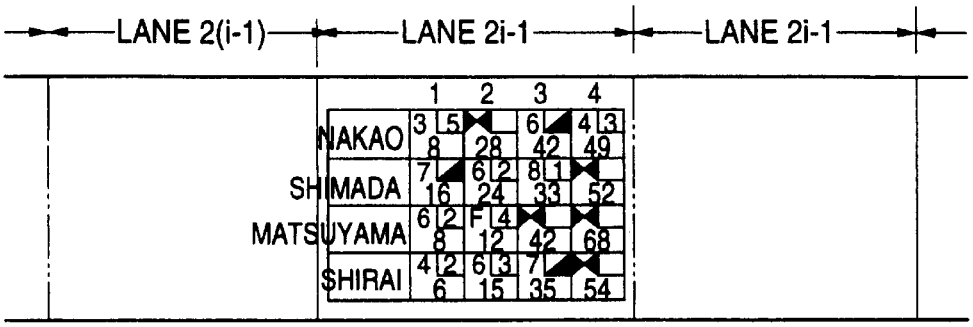
FIGS. 9A and 9B are views each showing a display example of the masking display.
Figure 9B:
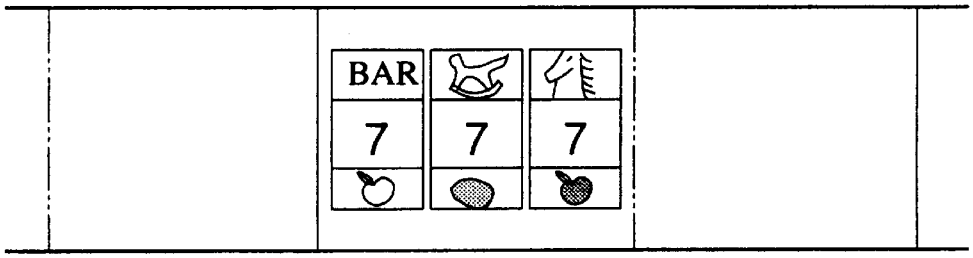

FIGS. 9A and 9B are views each showing a display example of the masking display, where the intervals designated as 2i−1 lane, 2i lane, and the like indicate the positions corresponding to the individual lanes, respectively; for example, when i=2, the intervals depicted in FIGS. 9A and 9B correspond to the second lane, the third lane and the fourth lane, as counted from the left. Since one masking display is made up of two lanes as described before, the 2i−1 lane and the 2i lane constitute the display range of one masking display in this example. FIG. 9A shows an example in which a score display is given for the 2i−1 lane, while FIG. 9B shows an example in which a state of a slot machine game as the additional game other than the bowling game is displayed.

Figure 10A:
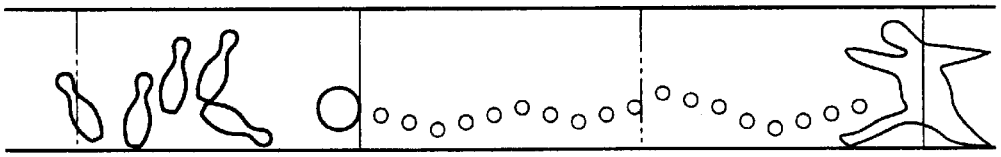
FIGS. 10A, 10B and 10C are views each showing another display example of the masking display.
Figure 10B:
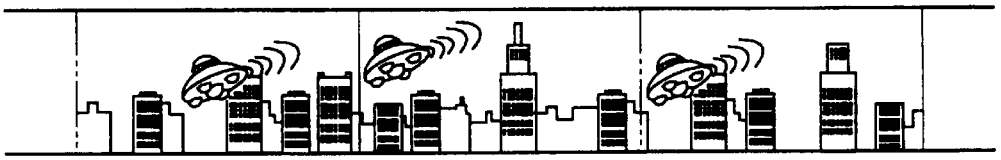
Figure 10C:
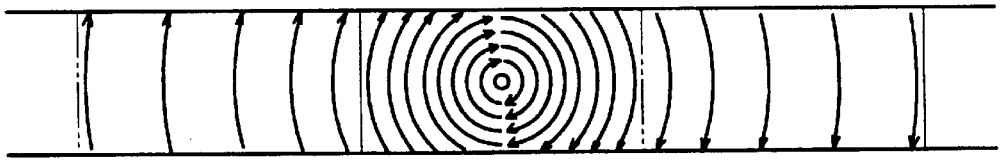

FIGS. 10A, 10B and 10C are views each showing a display example of the masking display in an empty lane, where effecting a series of decorative displays across adjacent masking displays makes it possible to display a large-screen powerful image as shown in FIGS. 10A and 10B. FIG. 10C shows a display example to be made according to the pin state after a bowl, the counting result of the score or the result of the additional game other than the bowling game, the example being a display on the masking display of the relevant lane in which a specific pattern is rotating and expanding around the position of the lane. Effecting such a display allows a unique state of the relevant lane to be widely known by utilizing a broad display area. In addition, if the range in which such a display is made is previously limited to the masking display for the lane used by the same group, bowlers who are playing the game in the other lanes will not be annoyed. In a reception of a plurality of bowlers who have come on in a group, which lane to lane is assigned to them is determined through operation with the host computer. Therefore, these information is contained in the host computer. Accordingly, in making such a display extending across a plurality of lanes as described above based on these information, the range of the display can be limited.

Such a display is performed by each console displaying a specified image on the corresponding masking display. In more detail, when the display contents of FIGS. 10A and 10B are still pictures, the front manager transfers still picture data to be displayed or file names and the like showing which data of the still picture data is reproduced, to specified consoles. When the contents are of a motion picture, the motion-picture file name is designated.

Figure 11A:
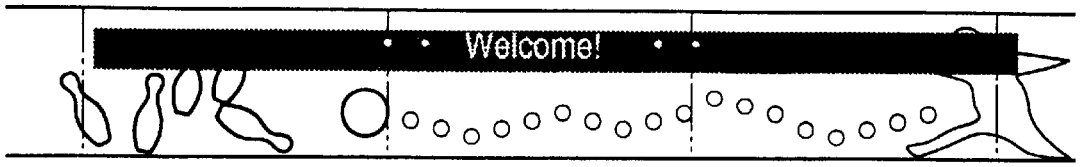
FIGS. 11A and 11B are views each showing another display example of the masking display.
Figure 11B:
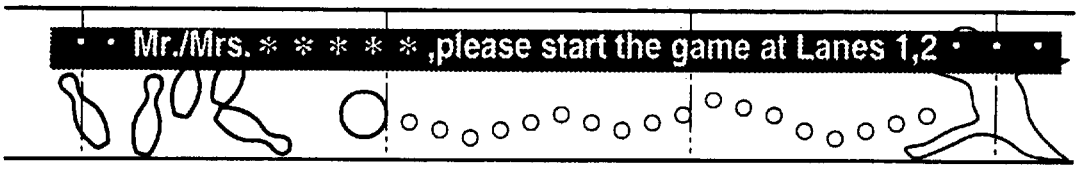

FIGS. 11A and 11B are cases in which some message is further displayed against such an image as shown in FIGS.

10A to 10C. In this case, character strings showing the message contents are moved and displayed as a telop continuously in the left-and-right direction across the screens of a plurality of masking displays. This makes it possible to draw attention to the message. As the display interface 19 shown in FIG. 4 comprises display memories for at least two frames, such a display is enabled by writing a still picture serving as the background as shown in FIG. 10A into the display memory of the first frame while writing a character string into the display memory of the second frame, and by outputting an image signal having the two kind of data superimposed together through logical operation in generating the image signal from the two display memories.

Figure 12:
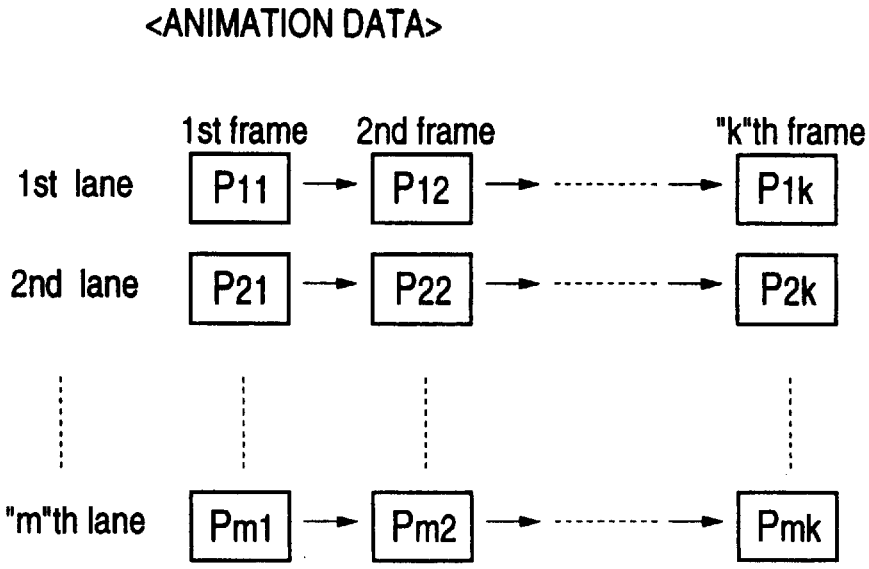
FIG. 12 is a view showing a structural example of animation data.

FIG. 12 show how video data for performing an animation display on a plurality of continuous masking displays is held. This case shows an example in which masking displays continuing from the first lane to the "m"th lane are used. Reference numeral and character P11 denotes video data of the first frame to be displayed on the masking display of the first lane, P21 denotes video data of the first frame to be displayed on the masking display of the second display, and Pm1 denotes video data of the first frame to be displayed on the masking display of the "m"th lane. Also, P12 denotes video data of the second frame to be displayed on the masking display of the first lane, P22 denotes video data of the second frame to be displayed on the masking display of the second lane, and Pm2 denotes video data of the second frame to be displayed on the masking display of the "m"th lane. Likewise, P1k denotes video data of the "k"th frame to be displayed on the masking display of the first lane, P2k denotes video data of the "k"th frame to be displayed on the masking display of the second lane, and Pmk denotes video data of the "k"th frame to be displayed on the masking display of the "m"th lane. In this way, by displaying the first to "k"th frames in succession on the masking displays of the first to "m"th lanes, an animation continuing (extending) across the masking displays of the first to "m"th lanes is displayed. Which segment of which animation is displayed on the masking display of which lane is specified by the front manager designating the animation file name on a specified console. Although the above example is described on a case where the animation is displayed on the masking displays of the first to "m"th lanes, yet the data for the animation display is, of course, not assumed to be given in correspondence to the individual lanes, but displayed onto the masking displays of any arbitrary continuous lanes by transferring the frame data of the arbitrary continuous lanes to their corresponding consoles. In addition, with small video data capacity of each frame, it may be arranged that the front manager transfers video data to specified consoles each time it is required, at a time point when these images should be displayed.

Figure 13A:
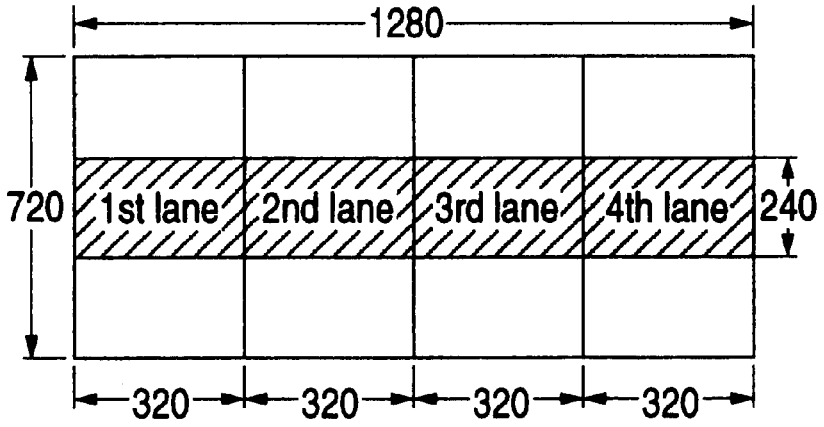
FIGS. 13A and 13B are views showing a structural example of the motion-picture file.
Figure 13B:
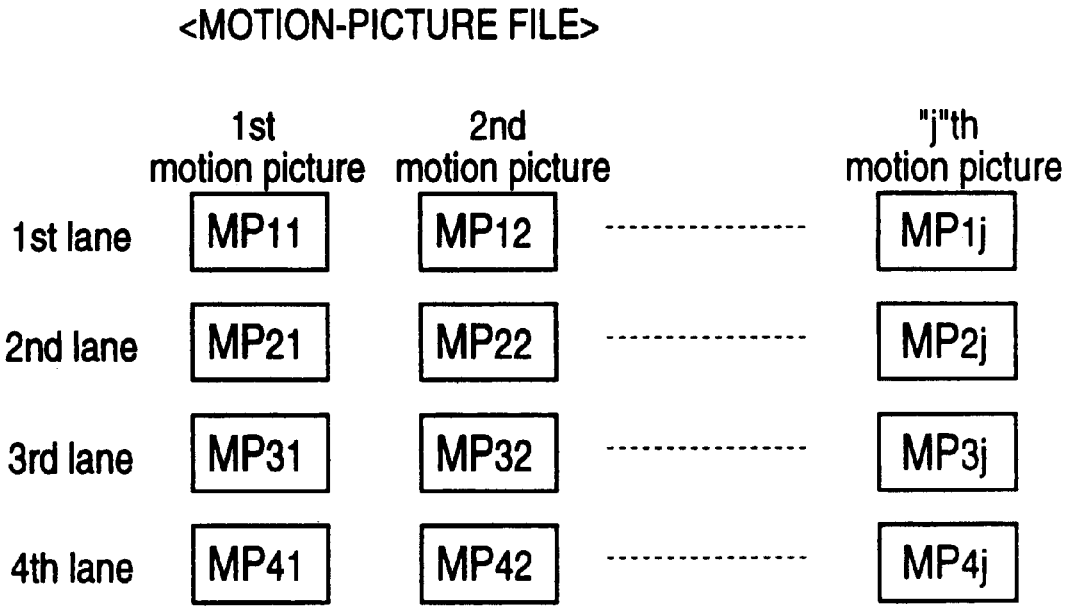

FIGS. 13A and 13B illustrate how a motion-picture file is held. In the example as shown in FIG. 13A, the SIF circuit in the motion picture/audio compressing circuit shown in FIG. 7 receives a video signal of horizontal 1280× vertical 720 pixels, and converts the format so that a block of horizontal 320× vertical 240 pixels is taken as one block and that the central horizontal one array composed of 4 blocks of the input video is taken each as a motion-picture file. Thus, the motion picture/audio compressing circuit prepares a series of motion pictures as four motion-picture files in succession. The video signal is given, for example, in one video format of the GA (Grand Alliance) standard, which is one of the HDTV digital broadcasting now under progress of standardization in Europe and America, and in compliance with the MPEG 2 main profile/high level MP@HL. In the example of FIG. 13B, for a series of the first motion pictures, a picture file to be displayed on the masking display of the first lane is prepared as MP11, a picture file -to be displayed on the masking display of the second lane is prepared as MP21, a picture file to be displayed on the masking display of the third lane is prepared as MP31, and a picture file to be displayed on the masking display of the fourth lane is prepared as MP41. Further, for a series of the second motion pictures, a picture file to be displayed on the masking display of the first lane is prepared as MP12, a picture file to be displayed on the masking display of the second lane is prepared as MP22, a picture file to be displayed on the masking display of the third lane is prepared as MP32, and a picture file to be displayed on the masking display of the fourth lane is prepared as MP42. Likewise, for a series of the "j"th motion pictures, a picture file to be displayed on the masking display of the first lane is prepared as MP1j, a picture file to be displayed on the masking display of the second lane is prepared as MP2j, a picture file to be displayed on the masking display of the third lane is prepared as MP3j, and a picture file to be displayed on the masking display of the fourth lane is prepared as MP4j. In displaying these motion pictures onto the masking displays, the file names of motion-picture files to be reproduced are designated to the relevant consoles. Although the above example is described on a case where the motion pictures are displayed on the masking displays of the first to fourth lanes, yet the data for such a motion-picture display is, of course, not assumed to be given in correspondence to the individual lanes, but displayed onto the masking displays of any arbitrary continuous lanes by transferring the file names of the motion-picture files of the arbitrary continuous lanes (continuous four lanes in this example) to the consoles in charge of the four lanes.

Figure 14A:
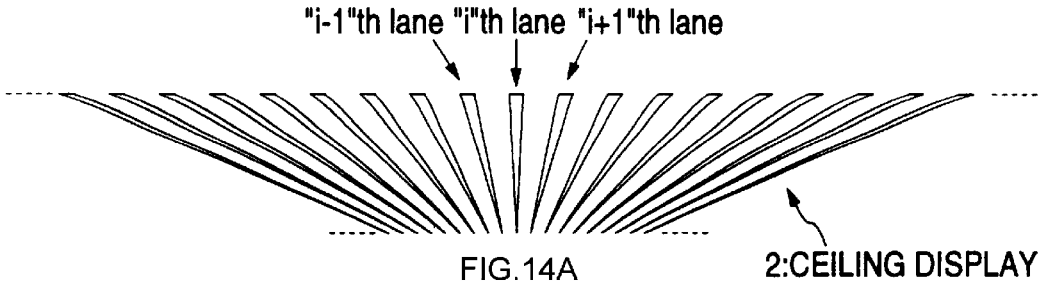
FIGS. 14A, 14B, 14C, 14D, 14E and 14F are views showing the configuration of the ceiling displays as well as display examples thereof.
Figure 14B:
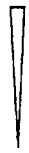
Figure 14C:
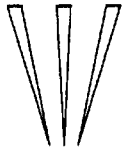
Figure 14D:
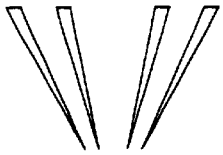
Figure 14E:
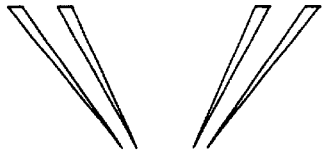
Figure 14F:
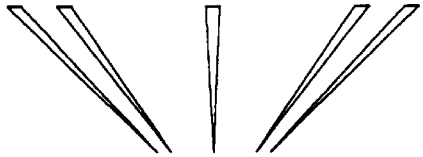

FIGS. 14A, 14B, 14C, 14D, 14E and 14F are views showing the arrangement of the ceiling displays as well as display patterns thereof. FIG. 14A shows a state that all the ceiling displays are in light emission. Now assuming that the start-up conditions for the ceiling display of the "i"th lane are satisfied by the bowling game or additional game in some lane, first the ceiling display above the "i"th lane is lit as shown in FIG. 14B, then the ceiling displays on both sides are lit as shown in FIG. 14C, and subsequently the ceiling displays on further both sides are lit as shown in FIG. 14D while the first ceiling display is turned out. In a similar manner, the light-emitting pattern is moved and displayed successively to right and left as in the order of FIGS. 14E→14F . . . . This makes it possible to effect a powerful display by utilizing a wide space of the ceiling, and moreover to clearly identify the lane that has caused the display.

Such a display is performed by the front manager transferring ceiling display light-emitting pattern data to the individual consoles. In more detail, by transferring the following data as the ceiling display light-emitting pattern data to the individual consoles, the console that has received this ceiling display light-emitting pattern data turns on and out the ceiling display every regular time interval in the order of turning-on and -out pattern shown by the data:

| | Order of turning-on and -out |
|---|---|
| "i-4"th lane: | 0000110... |
| "i-3"th lane: | 0001100... |
| "i-2"th lane: | 0011001... |
| "i-1"th lane: | 0110011... |
| "i"th lane: | 1100110... |
| "i+1"th lane: | 0110011... |

-continued

| | Order of turning-on and -out |
|---|---|
| "i+2"th lane: | 0011001... |
| "i+3"th lane: | 0001100... |
| "i+4"th lane: | 0000110... |

As a result of this, such a display as shown in FIG. 14 is accomplished as a whole.

Figure 15A:
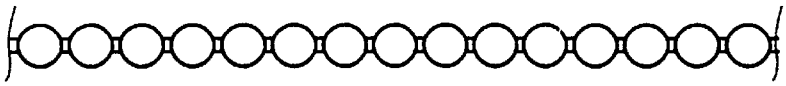
FIGS. 15A and 15B are views showing the configuration of the ceiling displays.
Figure 15B:
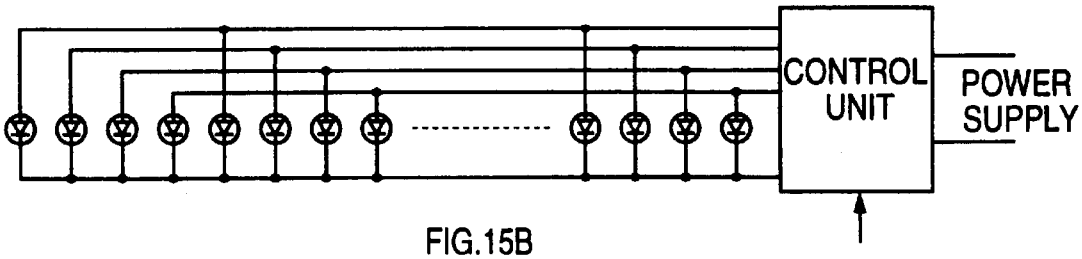

FIGS. 15A and 15B are views showing the configuration of one array of the ceiling displays. In FIG. 15A, LEDs are provided in individual bead-like portions, these are strung together with a lead wire to constitute one light emitter. FIG. 15B shows an equivalent circuit diagram thereof. In this way, a plurality of LEDs are connected in parallel in fixed-number units, in which arrangement conduction to these members is turned on and off so that the overall turn-on/overall turn-out or the light-emitting pattern is controlled. In this example, the LEDs are connected in common every four ones, in which arrangement the light-emitting position of the LEDs can be selected in four ways by means of a common lead wire and four power supply input lines.

Figure 16A:
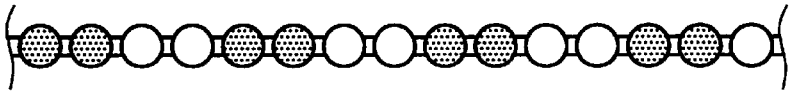
FIGS. 16A, 16B, 16C and 16D are views each showing another display example by using the ceiling displays.
Figure 16B:
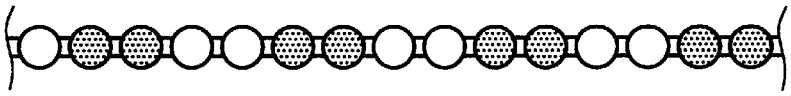
Figure 16C:
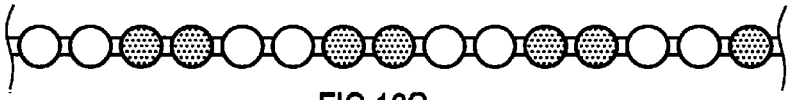
Figure 16D:
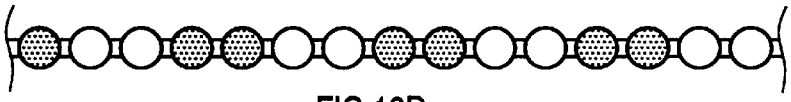

FIGS. 16A, 16B, 16C and 16D show a display example in which a motion as if the light-emitting pattern flowed is imparted by the switching of the control signal to the control unit shown in FIG. 15B. In more detail, as shown in FIG. 16A, the LEDs are turned on every two ones, and the two turn-on positions are changed over and over progressively in the order of FIGS. 16B→16→16→16A . . . , thereby imparting a flow to the light-emitting pattern. This control is effected by the control unit shown in FIG. 15B in response to control data (control command) from the consoles. Such a display may also be effected on only the ceiling displays above the lanes that satisfy the start-up conditions for the ceiling displays.

Figure 17:
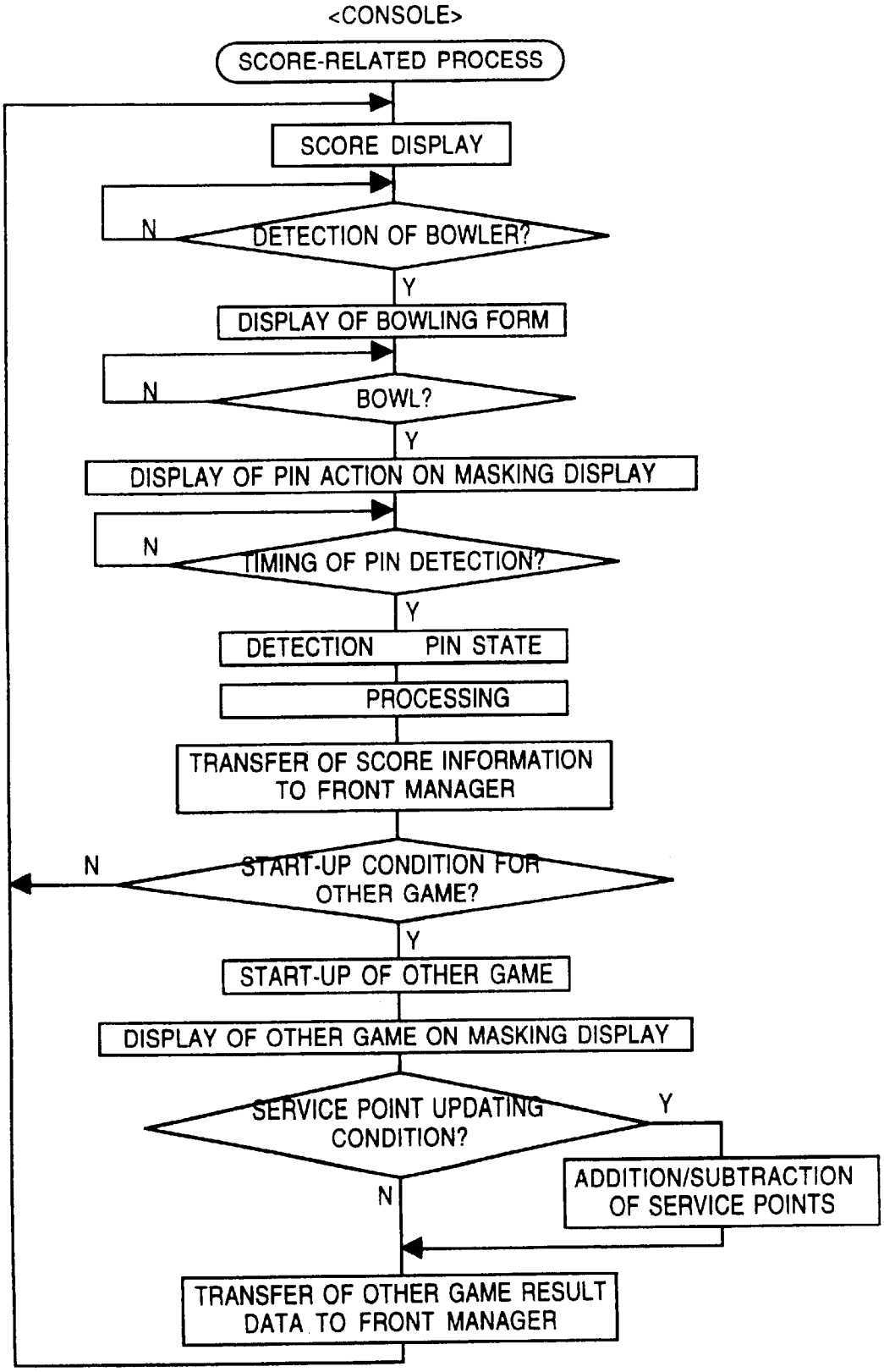
FIG. 17 is a flow chart showing the procedure of score-related process of the console.

FIG. 17 is a flow chart showing the procedure of score-related process in each console. A bowling score is first displayed, and then once a bowler's standing up in the approach has been detected by the bowler sensor 27, an image signal derived from the bowling form camera 7 is fed to the masking display. As a result, a mirror image of the bowler that is going to bowl is displayed on the masking display ahead. When it is detected by the first bowl pass sensor 6*a* that a bowling action has been done, the signal to be fed to the masking display is switched from the bowling form camera to the pin camera. As a result, a scene that pins are fallen down is displayed on the masking display as it is. Subsequently, 1 to 2 seconds after the second bowl pass sensor 6*b* senses a pass of the bowl, the down/erect state of pins is detected through the processing of the image picked up by the pin camera, and score processing is carried out according to the detection result. Then, the fact that a bowl has been performed and the score information as a result of the bowl are transferred to the host computer. Succeedingly, it is decided whether or not the conditions for starting up the additional game (a game other than the bowling game) have been satisfied as a result of the last bowl. For example, assuming that the start-up conditions include whether the pin state has come to a predetermined state such as a strike, whether the score state has come to a predetermined state such as a specific pattern of the score pattern or a specified value of the score total, and other conditions, satisfying these conditions leads to a chance of playing the slot machine game (a simulation of the slot machine), where such a display as shown in FIG. 9B is presented on the masking display. When the result of this additional game has come to a predetermined state, service points are added or subtracted. This "service points" is a service offered to the bowlers in the form of points; for instance, premium gifts or service tickets or the like responsive to the service points are given to the bowlers in the reckoning at the front desk. After that, the result of the additional game as well as the information about service points are transferred to the front manager. As will be described later, when the predetermined start-up conditions for the masking displays have been satisfied, for example when the additional game has come to a predetermined state as a 777 (three sevens) has come up in the slot machine game, a specified display will be displayed on the masking displays and the ceiling displays. In addition, in this example, the additional game is started up only when the predetermined start-up conditions are satisfied. However, the additional game may be started up each time a bowl is effected.

Figure 18:
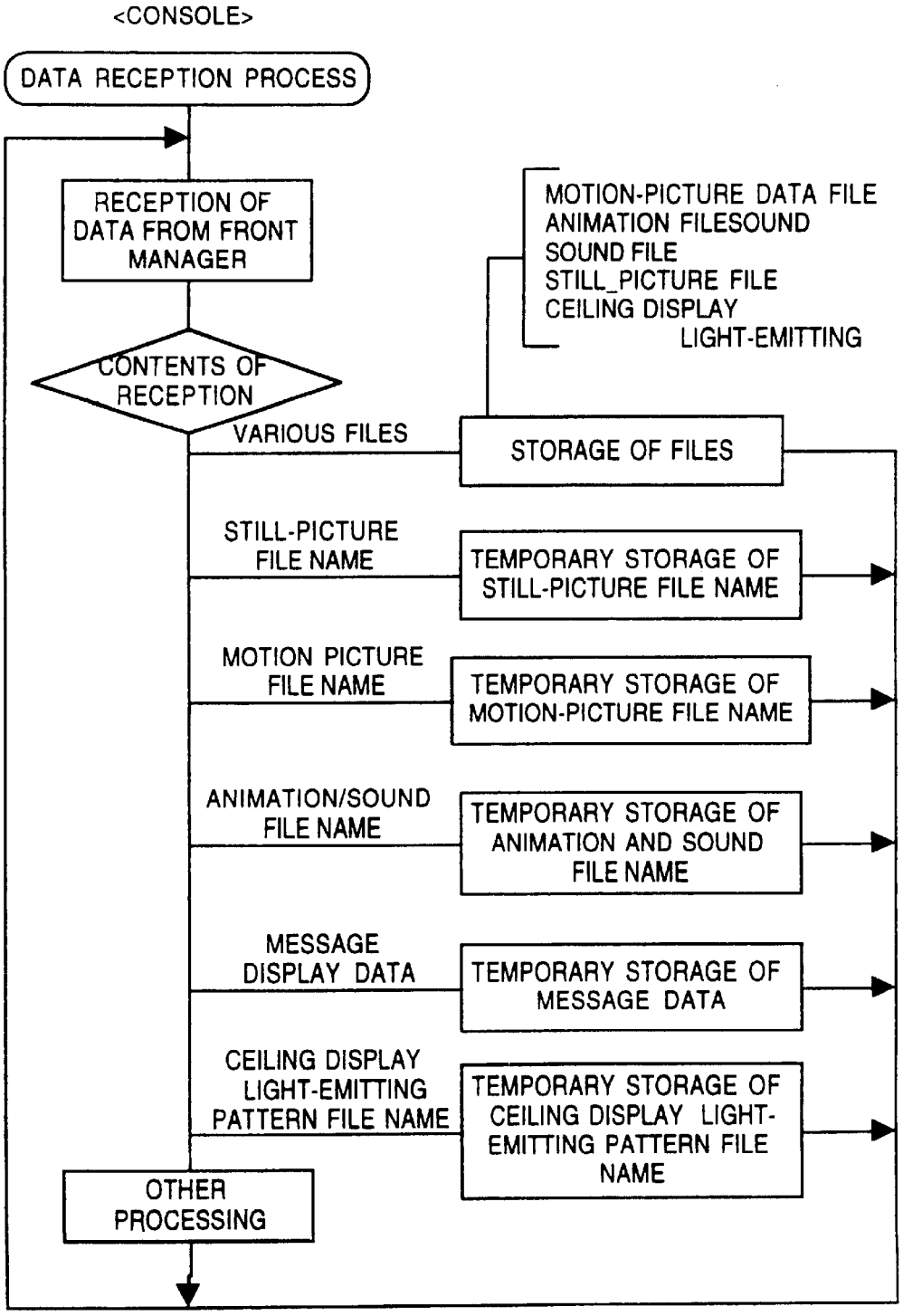
FIG. 18 is a flow chart showing the procedure of data reception process of the console.

FIG. 18 is a flow chart showing the procedure of data reception process in each console. First, a signal put on the local area network, where if the reception data is oriented to a console itself from the front manager, then the console captures the data and performs the subsequent processes responsive to the data. For example, if the data is a motion-picture file, a still-picture file, an animation file, a sound file, a ceiling display light-emitting pattern file or other various kinds of files, this data is stored at a specified address on the RAM so as to be drawable by their respective file names. Also, if the data received from the front manager is a still-picture file name, then the still-picture file name is temporarily stored. After that, as will be described later, upon receiving a synchronizing signal through the synchronizing signal cable 43 shown in FIG. 3, the console reads the data of the still-picture file that has already been stored and writes the still-picture data into the display memory within the display interface 19 shown in FIG. 4, thus displaying the specified still picture onto the masking display. If the data received from the front manager is a motion-picture file name, then the console temporarily stores the motion-picture file name, and if the received data is an animation/sound file name, then the console temporarily stores it. Also, if the data received from the front manager is a ceiling display light-emitting pattern file name, then the console temporarily stores the file name. After that, as will be described later, upon receiving a synchronizing signal through the synchronizing signal cable 43, the console starts the reproduction of the motion picture or the reproduction of the animation and sound along with the control of the turning-on and -out of the ceiling displays, based on their respectively specified ceiling display light-emitting pattern file name and motion-picture file name or the animation/sound file name. If the data received from the front manager is message display data, then the console temporarily stores the data. After that, upon receiving a synchronizing signal through the synchronizing signal cable 43, the console writes the message display data into the display memory for message display within the display interface 19 shown in FIG. 4, thus displaying such a message as shown in FIG. 11 as a telop.

Figure 19:
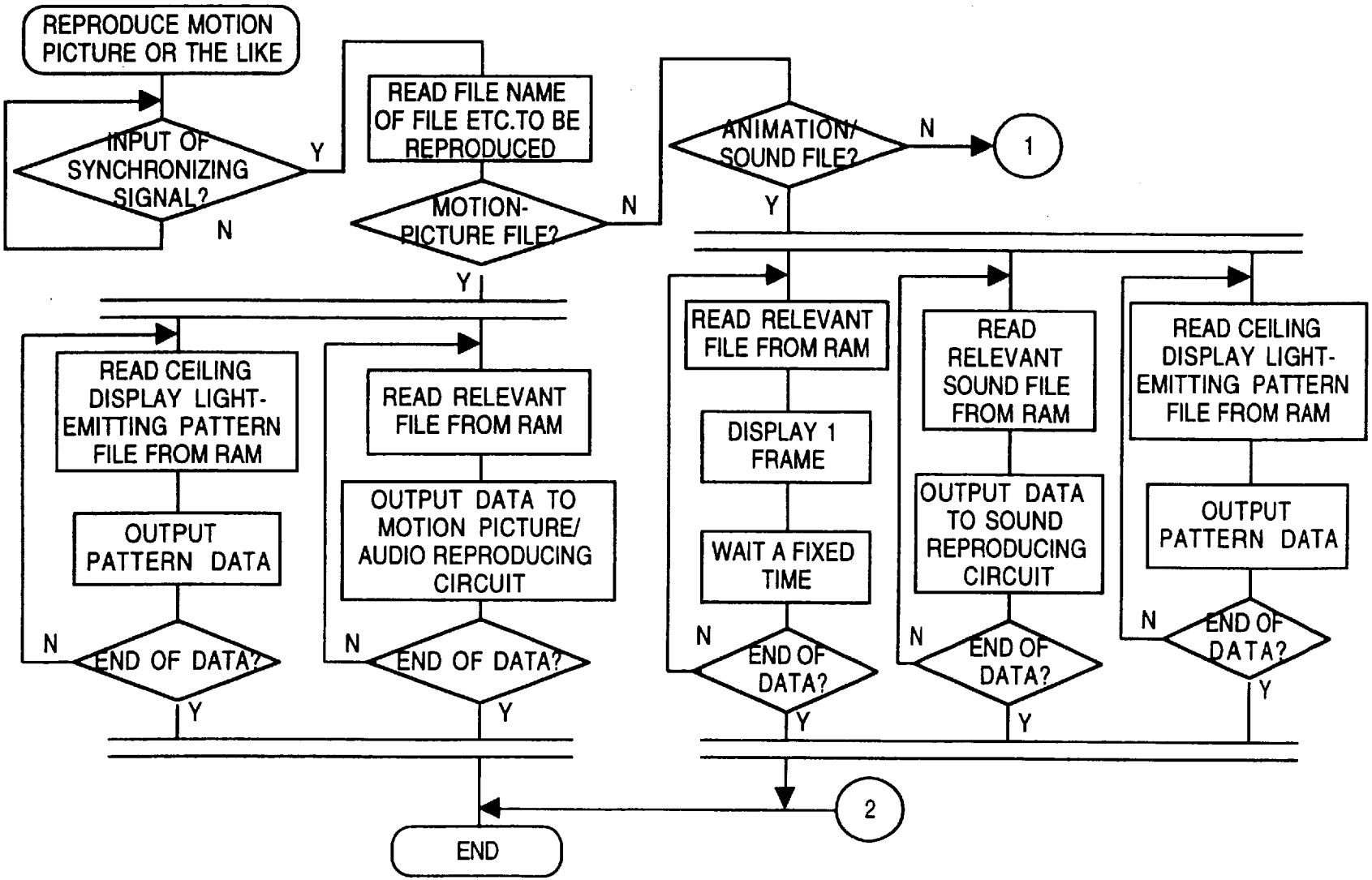
FIG. 19 is a flow chart showing the procedure of motion-picture or other reproduction process of the console.
Figure 20:
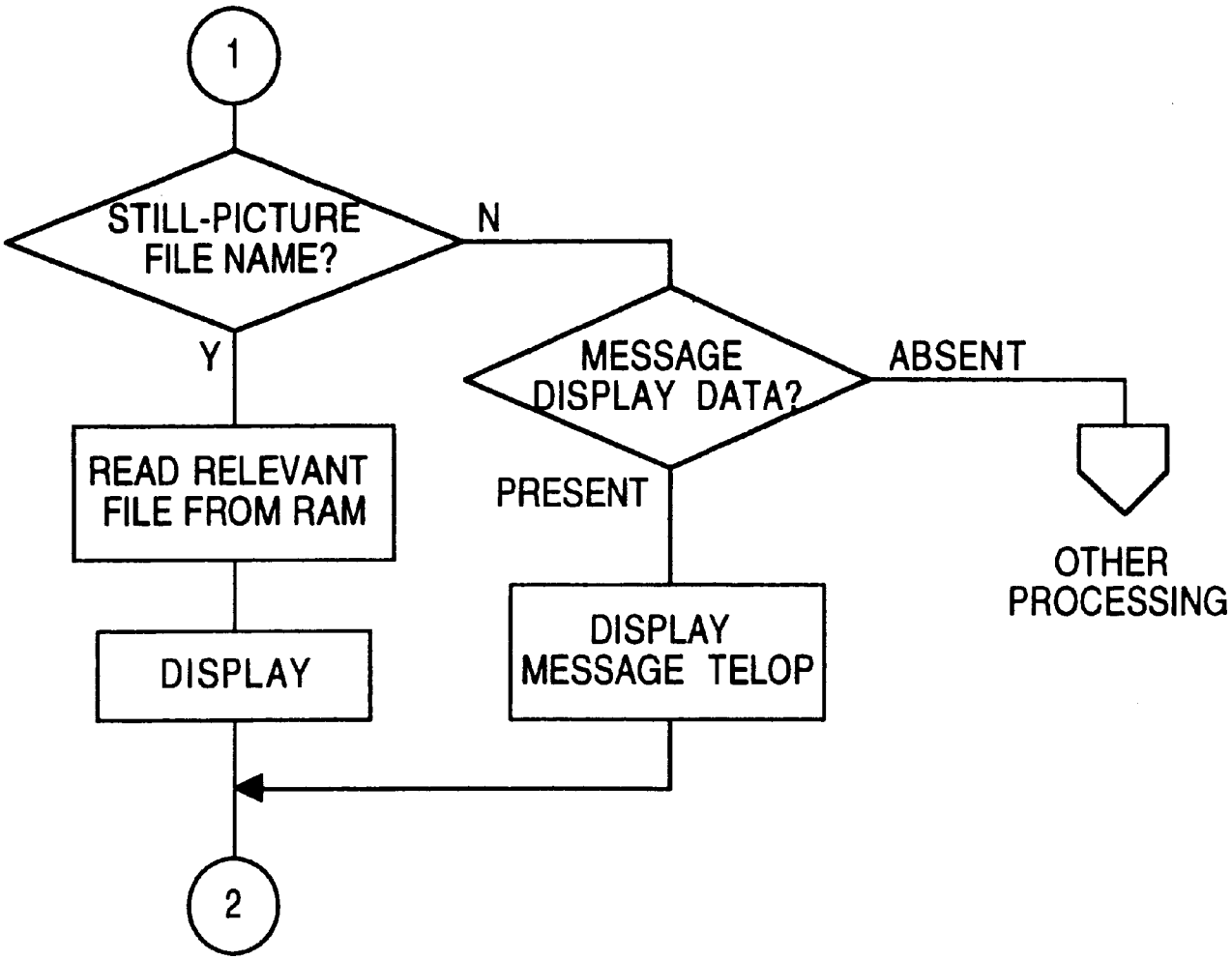
FIG. 20 is a flow chart showing the procedure of motion-picture or other reproduction process of the console.

FIGS. 19 and 20 are flow charts showing processing procedures to be started up upon the reception of the synchronizing signal. As shown in FIG. 19, upon reception of a synchronizing signal through the synchronizing signal cable 43, the file name or the like to be reproduced is first read. If the motion-picture file name has been stored as data to be reproduced, then the console reads the corresponding file data from the RAM that has stored the data, and delivers the data to the motion picture/audio reproducing circuit 20 shown in FIG. 4. This process is iteratively executed until the data is terminated. Thus, the reproduction of a series of motion pictures and the outputs of audio signals are carried out. Also, in parallel with this, the console reads ceiling display light-emitting pattern data from the RAM, and outputs the data successively to the ceiling display interface 16 shown in FIG. 4, by which the turning-on and -out of the ceiling displays is controlled. Otherwise, if the file name to be reproduced is an animation file name or a sound file name, then the console reads the corresponding animation file name from the RAM that has already stored the file name, and performs the first one-frame display and, after a specified time elapse, reads the succeeding data. This process is iterated at a cycle of, for example, 1/30 second, by which the animation is displayed. Also, in parallel with this, the console reads the corresponding sound file from the RAM, and iterates the process of delivering the data to the sound reproducing circuit 26 shown in FIG. 4, thus reproducing the sound. Further, in parallel with this, the console reads the ceiling display light-emitting pattern data from the RAM, and outputs the data successively to the ceiling display interface 16 shown in FIG. 4, by which the turning-on and -out of the ceiling displays is controlled. Otherwise, if a still-picture file name is stored as shown in FIG. 20, the console reads the contents of the corresponding still-picture file from the RAM, and writes the still-picture data into the display memory within the display interface 19 shown in FIG. 4, by which the specified still picture is displayed onto the masking display. Otherwise, if message display data is stored, then the console writes it into the display memory for message display within the display interface 19 shown in FIG. 4, by which such a message as shown in FIG. 11 is displayed as a telop.

Figure 21:
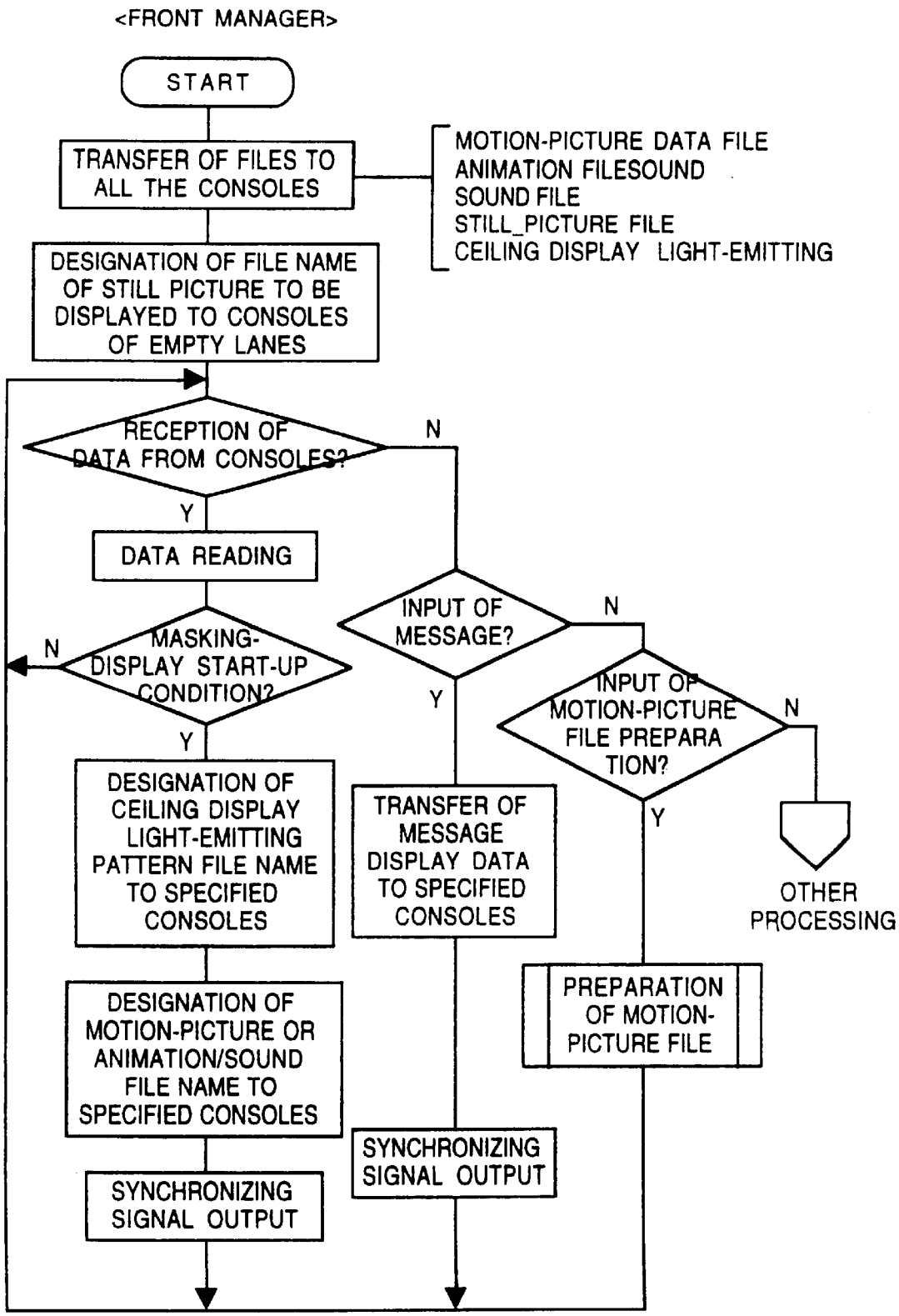
FIG. 21 is a flow chart showing the procedure of processing of the front manager.

Now, FIG. 21 is a flow chart showing the procedure of normal processing on the front manager side. First, the front manager transfers to all the consoles a motion-picture file, an animation file, a sound file, a still-picture file and a ceiling display light-emitting pattern file. Each console stores these files successively in specified area of the RAM. Subsequently, the front manager specifies (transfers) the still-picture file name to be displayed on the masking display of an empty lane state to the corresponding console. As a result, such a display as shown in FIG. 10A or 10B is performed on the masking display of the empty lane. In addition, because of the fact that the still picture is completed in a plurality of lanes in such an example as shown in FIG. 10A, when a large number of lanes larger than the above number of completing lanes are in an empty lane state, the front manager gives each console a designation of the still-picture file name to be reproduced in such a manner that a series of these still pictures will be displayed as an iterated pattern. Otherwise, in such an example as shown in FIG. 10B, because the continuity of display contents on the masking display will not be impaired between adjacent lanes whichever still picture is selected out of these three kinds of still pictures in the unit of one lane, it is appropriate to designate a still-picture file at random in such a manner that any of the three kinds of still pictures will be displayed on the masking displays of the empty lanes.

Figure 22:
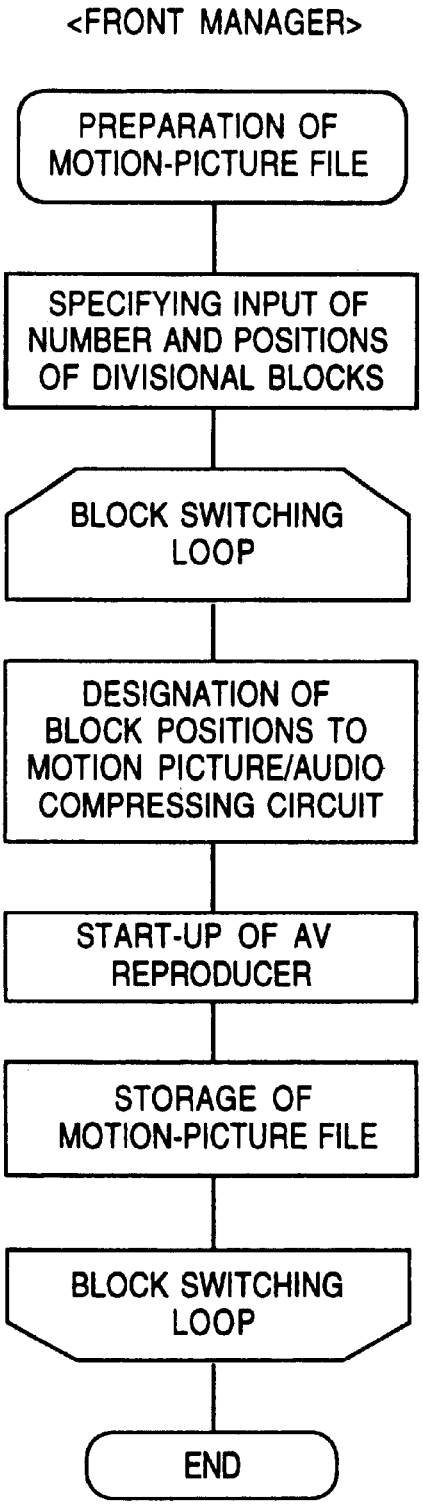
FIG. 22 is a flow chart showing the procedure of motion-picture file preparing process of the front manager.

Reverting to the explanation of FIG. 21, the front manager receives data from the individual consoles afterwards, and performs processing responsive to the data. For instance, the front manager reads data from the individual consoles to monitor the state of the consoles, where if the predetermined start-up conditions for the masking displays are satisfied, such as when a 777 (three sevens) has come up in a lane, the front manager transfers the file name of the ceiling display light-emitting pattern file to specified consoles (to all the ceiling displays, if employed as shown in FIG. 14). Subsequently, the front manager specifies the motion-picture file name or animation file name and the sound file name to the consoles corresponding to the lanes to which the motion picture or animation is to be displayed. After that, the front manager outputs a synchronizing signal through the synchronizing signal cable 43. As a result, the relevant consoles, upon receiving the synchronizing signal, controls the light emission of the ceiling displays according to the ceiling display light-emitting pattern file name that has already been specified, while it displays the specified motion picture or animation. In the above-described example, the masking display start-up condition has been that the result of the additional game other than the bowling game has come to a predetermined state. Otherwise, the start-up condition may be whether the pin state after a bowl has come to a specific state such as the occurrence of a strike, whether the score state has come to a specific state such as a specific pattern of the score pattern, or the like. Also, the front manager, upon receiving a message from the keyboard, transfers message display data to specified consoles responsive to the message, and then outputs a synchronizing signal through the synchronizing signal cable 43. As a result, such a message as shown in FIG. 11 is displayed simultaneously across the specified masking displays. Also, the front manager prepares a motion-picture file off-line. FIG. 22 is a flow chart showing the procedure therefor. First as shown in FIG. 13A, the front manager specifies how the input image is divided and which blocks are assigned as the area for the display onto the masking displays, subsequently, the front manager specifies the first block to the motion picture/audio compressing circuit while it starts up the AV reproducer 76 shown in FIG. 6. As a result, MPEG system streams are generated by the motion picture/audio compressing circuit 75, and stored successively as a motion-picture file. This process is performed iteratively for a plurality of blocks, by which a motion-picture file capable of displaying a series of motion pictures on continuous masking displays is prepared.

Figure 23:
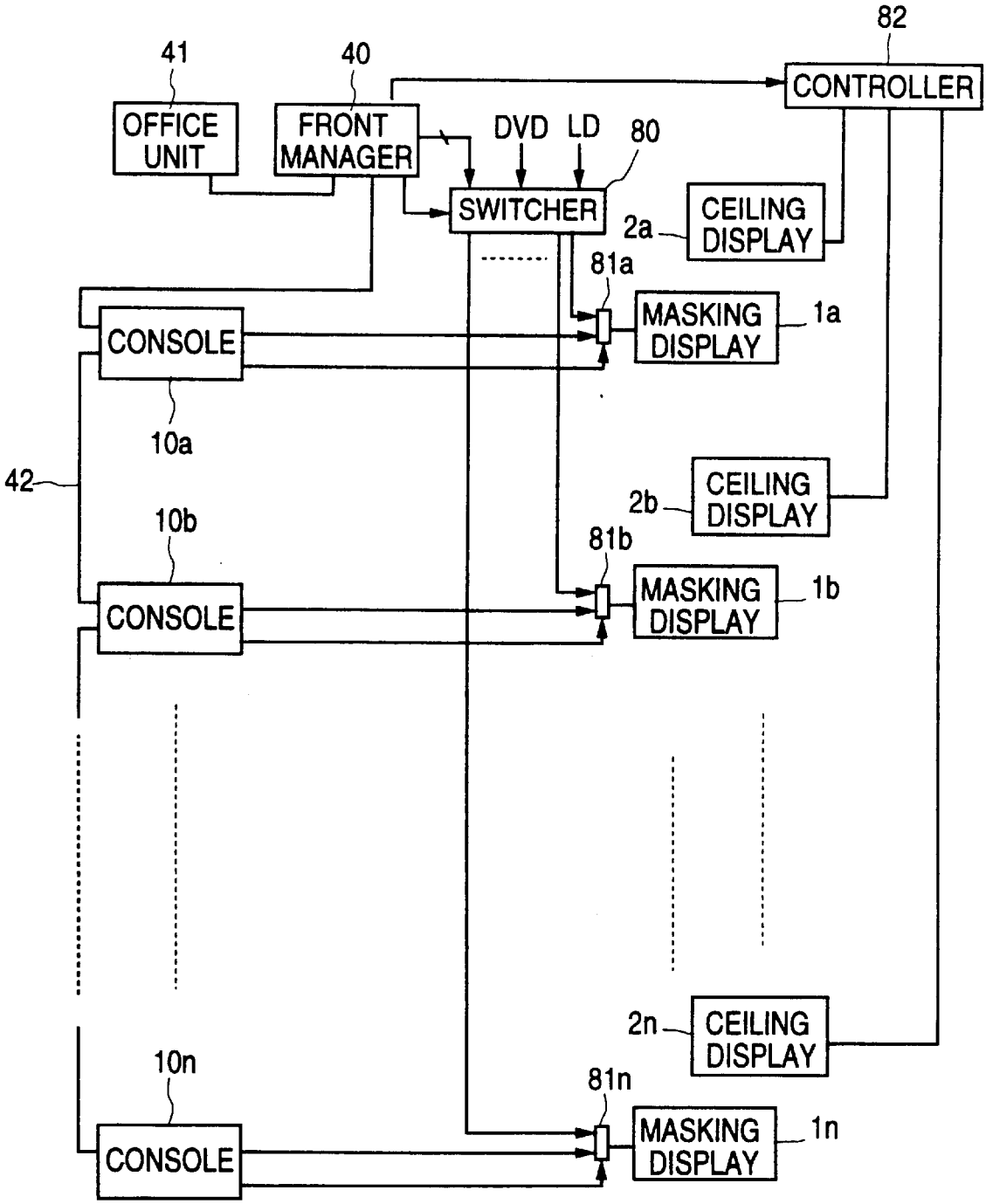
FIG. 23 is a block diagram showing the configuration of a display unit for bowling alleys according to another embodiment of the present invention.

FIG. 23 is an overall block diagram according to another embodiment. In the foregoing embodiment, it has been arranged that the front manager specifies to the individual consoles the file names of a still picture, a motion picture, an animation or the like to be displayed on the masking displays so that a continuous image will be displayed across adjacent masking displays. However, FIG. 23 is an example in which the display contents for the individual masking displays are generated independently of one another by the front manager and given to the corresponding masking displays. In more detail, referring to FIG. 23, a switcher 80, which is a matrix switcher, receives an image signal of a plurality of frames from the front manager 40, and gives the image signal to specified masking displays out of a plurality of masking displays. The front manager 40 delivers the image signal to some continuous masking displays simultaneously via the switcher 80. As a result, such a display as shown in FIGS. 10 and 11 is carried out. Designated by numerals 81*a*, 81*b*, . . . , 81*n* are switch circuits, respectively, which select either one of the image signal from the switcher 80 or the image signal from the console in response to switching signals derived from the consoles 10*a*, 10*b*, . . . , 10*n*, and deliver the signal to the masking display 1*a*, 1*b*, . . . , 1*n*. Also, to the switcher 80 are connected AV reproducers such as LD and DVD, each of which displays the reproducing signal onto the masking displays selected by the front manager 40. Further referring to FIG. 23, a controller 82 is a circuit for performing the control of ceiling displays 2*a*, 2*b*, . . . , 2*n*, while the front manager 40 gives lane numbers and the like to the controller 82 to perform the light-emission control of the ceiling displays above the relevant lane or such turning-on and -out control of a light-emitting pattern expanding in the right-and-left direction around the lane, as in the foregoing embodiment.

As described above, since the wall surface is utilized as a display surface, the bowler is allowed to view the score or the like even if present in the approach. Also, since a wide display surface extending across a multiplicity of lanes can be used, it. becomes possible, for example, to display an image that has a great incentive power to all the people within the bowling alley including bowlers present in the approach and spectators present in the passages between the consoles and the front desk.

Further, results of pin state detection, results of score counting or state of a game other than bowling game will be displayed so as to extend across the display surfaces of a plurality of display units. As a result, a powerful display with an abundance of information and a high visibility becomes a reality.

Further, even if the display unit is not provided for each lane, a display for each lane can be implemented by providing the display unit for every some plurality of lanes.

Further, the wall surface covering the pin setter is simplified in structure and yet the space above the pin setter can be put into effective use.

Further, in a sight toward the pin array from the approach, the console installation, position, the further rear passages or the like, the ceiling above the lane or its proximities will emit light. As a result, a powerful display with high incentive is enabled.

Further, since a light-emitting pattern is moved and displayed while the light emitter is switched between light-emitting state and non-light-emitting state, a light-emitting pattern will flow within a wide space, thus allowing the incentive power to be further enhanced.

What is claimed is:

1. A display unit for a bowling alley having a plurality of lanes, the display unit comprising:

a plurality of light emitters provided at a ceiling portion, or its peripheries, positioned above each of the plurality of lanes; and a light emitter drive controller configured to control the plurality of light emitters across the plurality of lanes according to a specified pin state of bowling pins in at least one of the plurality of lanes, wherein said plurality of light emitters extends substantially along a length of the plurality of lanes.

2. The display unit for a bowling alley according to claim 1, further comprising:

a pin-state detector for detecting a pin state of bowling pins after a bowl, wherein the specified state is the pin state detected by the pin-state detector.

3. The display unit for a bowling alley according to claim 1, further comprising:

a pin-state detector for detecting a pin state of bowling pins after a bowl; and a score counter for counting score of a bowling game based on the pin state, wherein the specified state is the counted score.

4. The display unit for a bowling alley according to claim 1, wherein the light-emitter drive controller controls a display of a light-emitting pattern of the light emitters by controlling a switching of the light emitters between a light-emitting state and a non-light-emitting state.

5. A display unit for a bowling alley having a plurality of lanes, an approach area corresponding to each of said lanes, and a pin setter corresponding to each of said lanes, the display unit comprising:

a plurality of display devices each having a support and a display surface, wherein each display device is associated with at least one of said lanes and at least one of said corresponding pin setters; and a display controller for controlling display contents of the plurality of display devices according to a specified pin state, wherein said support is located beside said at least one associated lane and proximate said at least one associated pin setter, said display surface is located proximate to said associated at least one pin setter, said display control is configured to cause said display contents of at least two display devices to form a combined image, and said display device masks said at least one associated pin setter from view by a bowler standing in said approach to said associated lane.

6. The display unit of claim 5, wherein said combined image is formed from the display contents of at least two adjacent display devices.

7. The display unit of claim 5, wherein each of said display devices further includes a projector configured to project display content on said display surface.

8. The display unit of claim 5, wherein said display surface of one of said display devices is substantially contiguous with said display surface of a second of said display devices.

9. The display unit of claim 5, wherein said combined imagine is displayed upon the occurrence of a specified event.

10. A display unit for a bowling alley having a lane, the display unit comprising:

a plurality of light emitters provided at a ceiling portion, or its peripheries, positioned above the lane; and a light emitter drive controller configured to control the plurality of light emitters according to a specified pin state of bowling pins, wherein the plurality of light emitters extends substantially along a length of said lane, and the light-emitter drive controller controls a display of a light-emitting pattern of the light emitters by controlling a switching of the light emitters between a light-emitting state and a non-light-emitting state.

* * * * *